United States Patent [19]

Thaheld et al.

[11] 4,007,698

[45] Feb. 15, 1977

[54] MOTOR DRIVEN TUFTING MACHINE

[75] Inventors: Fred A. Thaheld; Fred H. Thaheld, both of Minden, Nev.

[73] Assignee: Rumplestiltskin's Craft Shop, Inc., Portland, Oreg.

[22] Filed: June 25, 1975

[21] Appl. No.: 590,325

[52] U.S. Cl. ..... 112/80; 248/14; 248/26; 310/51; 310/91

[51] Int. Cl.[2] ..... D05C 15/06

[58] Field of Search ..... 112/80, 169, 79 R, 79 A, 112/218 R, 220; 310/51, 91, 50, 71; 248/14, 26

[56] References Cited

UNITED STATES PATENTS

| | | | |
|---|---|---|---|
| 2,887,076 | 5/1959 | Sterner | 112/80 |
| 2,948,502 | 8/1960 | Hutton | 248/26 X |
| 2,970,236 | 1/1961 | De Paul et al. | 310/91 |
| 3,396,294 | 8/1968 | Makino | 310/51 X |
| 3,418,504 | 12/1968 | Paule et al. | 310/51 X |
| 3,491,259 | 1/1970 | Damijonaitis et al. | 310/50 |
| 3,553,506 | 1/1971 | Fresard | 310/51 X |
| 3,691,407 | 9/1972 | Klett et al. | 310/50 |
| 3,830,595 | 8/1974 | Carpenter et al. | 310/91 X |

*Primary Examiner*—H. Hampton Hunter
*Attorney, Agent, or Firm*—Lyon & Lyon

[57] ABSTRACT

A hand held motor driven tufting machine employs concentric needles which reciprocate and oscillate in timed relationship to form loops of yarn on a backing sheet. An electric motor drives the moving parts of the device, and this motor has a metallic frame anchored within and closed by a lightweight housing formed of plastic materials. An improved form of joints connect the metallic frame of the motor to mounting supports formed of plastic materials to prevent failure of the joints under stresses caused by gravity and by vibrations generated by a reciprocating motion of the moving parts.

1 Claim, 5 Drawing Figures

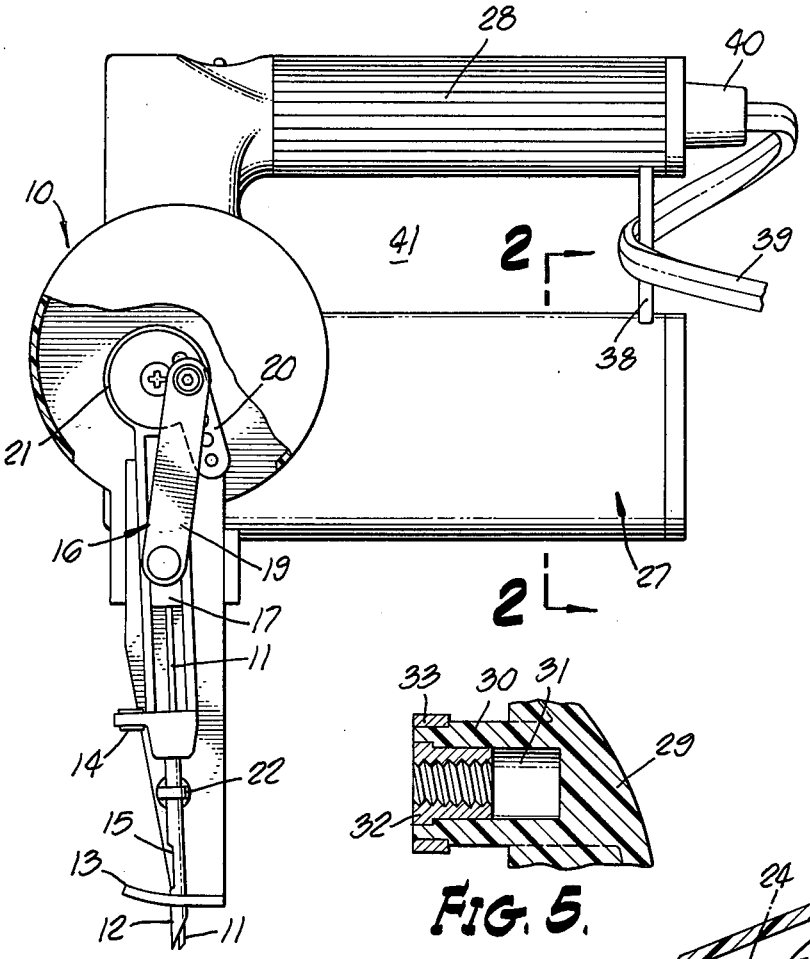
FIG. 1.
FIG. 5.
FIG. 4.
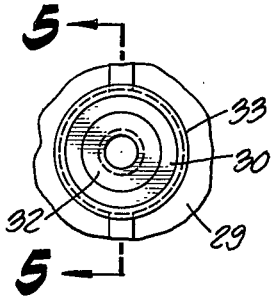
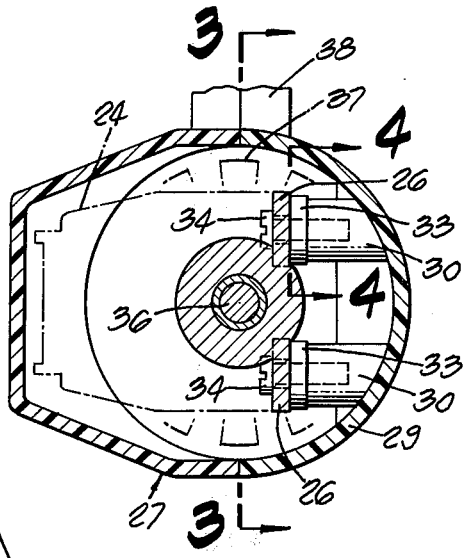
FIG. 2.
FIG. 3.
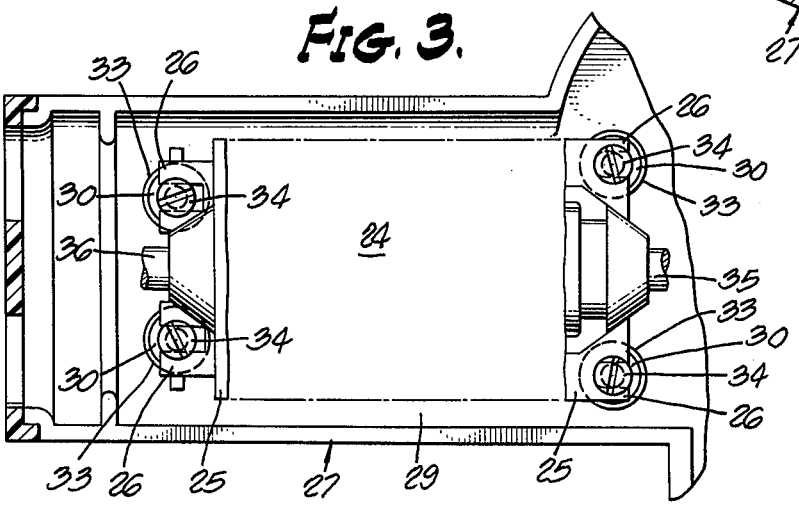

MOTOR DRIVEN TUFTING MACHINE

This invention relates to hand held power operated tufting machines having concentric needles which oscillate and reciprocate to form loops of yarn on a backing sheet. This invention relates to improvements over Applicants' copending application Ser. No. 231,257 filed Mar. 2, 1972, now abandoned.

In the general plan of operation, the backing sheet on which the loops of yarn are to be formed is supported in stationary horizontal position while the tufting machine is supported by hand with its foot piece in contact with the upper surface of the backing sheet, the concentric needles being supported in approximately vertical position. The electric motor for driving the tufting mechanism is supported in horizontal position within a protective housing formed of lightweight plastic materials. A horizontal handle spaced above the motor housing is positioned and proportioned so that one hand of the user may grasp the handle to support and guide the entire device.

Difficulty has been encountered in maintaining motor mount connections against damage, by reason of the weight of the motor and vibrations generated by the reciprocating actions of the concentric needles and their associated parts. It is an important feature of this invention to provide improved motor mount connections for supporting the electric motor within its enclosing housing.

Other and more detailed objects and advantages will appear hereinafter. In the drawings: FIG. 1 is a side elevation of the entire device.

FIG. 2 is a sectional view taken substantially on the lines 2—2 as shown in FIG. 1.

FIG. 3 is an elevation partly in section taken substantially on the lines 3—3 as shown in FIG. 2.

FIG. 4 is a sectional detail taken substantially on the lines 4—4 as shown in FIG. 2.

FIG. 5 is a sectional detail taken substantially on the lines 5—5 as shown in FIG. 4.

Referring to the drawings, the tufting maching generally designated 10 includes a pair of reciprocating and oscillating concentric needles 11 and 12 which move relative to a stationary foot piece 13. A backing sheet, not shown, is contacted by the lower face of the foot piece 13 so that the needles may form loops of yarn thereon, the yarn passing through the guide 14 and window 15 in the outer hollow needle 12. The mechanism generally designated 16 for moving the concentric needles 11 and 12 is substantially the same as that disclosed in said prior application and includes a slide block 17 fixed to the inner needle 11 and guided for reciprocating movement on the body 18 to which the outer hollow needle 12 is fixed. A link 19 driven from a crank arm 20 causes the slide block 17 and inner needle 11 to reciprocate. The upper end of the body 18 encircles a rotary eccentric 21 which turns with the crank arm 20, thereby causing orbital movement of the upper end of the body 18. A stationary guide 22 receives the outer surface of the hollow needle 12 in sliding contact.

As shown in FIG. 3, the electric motor 24 has a metallic frame 25 provided with four bifurcated supports 26. The motor 24 is enclosed within a split housing 27 formed of lightweight plastic materials, in order to minimize the total weight which must be supported by the hand of the user on the handle grip 28.

One housing part 29 is provided with four laterally projecting bosses 30 each formed integrally with the housing part 29. As best shown in FIG. 5, each boss 30 has a central opening into which is press fitted an internally threaded metallic sleeve 32. An external metallic ring 33 encircles each boss 30 at its projecting end, thereby confining an annular region of the boss 30 between the metallic sleeve 32 and the metallic ring 33. Splitting or deformation of the bosses 30 is thereby effectively prevented. A threaded fastening 34 passes through each of the motor supports 26 and is received within one of the stationary threaded sleeves 32. This provides solid supports for the motor 24 which retain their integrity during use against vibration generated by the motor driven mechanism 16.

One end 35 of the motor shaft drives the mechanism 16 through gearing, not shown, and the other end 36 of the motor shaft drives a cooling fan 37 shown in phantom lines in FIG. 2.

A stationary strut 38 spans the gap between the horizontal housing 27 for the motor 24 and the handle grip 28. A flexible multiconductor electric cable 39 has a conventional terminal 40 at one end to supply power for the electric motor. The cable 39 is passed around the strut 38 and through the space 41 between the housing 27 and the grip handle 28. This minimizes stresses at the joint between the cable 39 and the terminal 40 and substantially increases the service life of the cable 39.

Having fully described our invention, it is to be understood that we are not to be limited to the details herein set forth but that our invention is of the full scope of the appended claims.

We claim:

1. In a hand held power operated tufting machine having concentric needles for forming loops of yarn on a backing sheet, the combination of: mechanism for reciprocating and oscillating said needles, an electric motor for driving said mechanism, said motor being mounted within and enclosed by a housing formed of lightweight plastic material, said housing having a plurality of inwardly projecting bosses each formed integrally with said housing, each boss having an opening receiving an internally threaded metal sleeve, an annular metal reinforcing ring completely encircling the projecting end of each boss to confine an annular region thereof between the ring and said sleeve, and threaded fasteners securing said motor to each said internally threaded sleeves.

* * * * *